US007742707B2

(12) United States Patent
Kawai

(10) Patent No.: US 7,742,707 B2
(45) Date of Patent: Jun. 22, 2010

(54) FUNCTION EXECUTING DEVICE

(75) Inventor: Sunao Kawai, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 220 days.

(21) Appl. No.: 12/068,051

(22) Filed: Feb. 1, 2008

(65) Prior Publication Data

US 2008/0187327 A1 Aug. 7, 2008

(30) Foreign Application Priority Data

Feb. 2, 2007 (JP) ..... 2007-024441

(51) Int. Cl.
*G03G 15/00* (2006.01)

(52) U.S. Cl. ..... 399/8; 399/12; 399/24

(58) Field of Classification Search ..... 399/8, 399/12, 24, 25, 27
See application file for complete search history.

(56) References Cited

U.S. PATENT DOCUMENTS

| | | | | |
|---|---|---|---|---|
| 5,373,349 | A * | 12/1994 | Ito | 399/8 |
| 5,459,552 | A * | 10/1995 | Ohira | 399/8 X |
| 6,842,588 | B2 * | 1/2005 | Haines | 399/8 |
| 7,164,351 | B2 * | 1/2007 | Matsumae et al. | 399/8 X |
| 7,430,379 | B2 * | 9/2008 | Lee | 399/12 |
| 2003/0202202 | A1 | 10/2003 | Miyata | |
| 2006/0034625 | A1 | 2/2006 | Kajikawa | |

FOREIGN PATENT DOCUMENTS

| | | |
|---|---|---|
| JP | 5-246572 | 9/1993 |
| JP | 5-284309 | 10/1993 |
| JP | 8-230286 | 9/1996 |
| JP | 10-39674 | 2/1998 |
| JP | 10-301726 | 11/1998 |
| JP | 2001-228761 | 8/2001 |
| JP | 2003-30512 | 1/2003 |
| JP | 2004-86448 | 3/2004 |
| JP | 2004-173088 | 6/2004 |
| JP | 2006-79529 | 3/2006 |

* cited by examiner

*Primary Examiner*—Sandra L Brase
(74) *Attorney, Agent, or Firm*—Banner & Witcoff, Ltd.

(57) ABSTRACT

A function executing device for executing a function by utilizing a consumption article may be provided with a device main body, a sensor, an information output device, and a controller. A consumption article housing case for housing the consumption article may be mounted on the device main body. The sensor may detect the quantity of the consumption article within the consumption article housing case mounted on the device main body. The information output device may output information to the exterior in a case where the quantity of the consumption article within the consumption article housing case mounted on the device main body has become less than a predetermined quantity. The controller may prevent the information output device from outputting the information twice or more in a period between a time where the consumption article housing case is mounted on the device main body and a time where the consumption article housing case is dismounted from the device main body and a next consumption article housing case is mounted on the device main body.

14 Claims, 9 Drawing Sheets

FUNCTION EXECUTING DEVICE

CROSS-REFERENCE TO RELATED APPLICATION

This application claims priority to Japanese Patent Application No. 2007-024441, filed on Feb. 2, 2007, the contents of which are hereby incorporated by reference into the present application.

BACKGROUND OF THE INVENTION

1. Field of the Invention

The present invention relates to a function executing device for executing a function by utilizing a consumption article.

2. Description of the Related Art

A printer that executes a printing function utilizing a consumption article such as, for example, toner, ink, etc. is widely known. Japanese Patent Application Publication No. 2001-228761 teaches a system comprising a printer, and a service center connected with the printer via a remote communication network. The printer comprises a sensor that detects the quantity of toner within a toner cartridge. When the sensor detects that the quantity of toner is equal to or below a predetermined quantity, the printer sends a toner low signal to the service center. The service center can thus recognize that the toner cartridge must be replenished.

BRIEF SUMMARY OF THE INVENTION

The present inventor discovered that, with respect to one consumption article case (in the toner cartridge in the above example), the sensor may detect multiple times that the quantity of a consumption article within the consumption article case has become low. Various causes for this may be conjectured. For example, the sensor may operate incorrectly and perform detection a plurality of times. Further, even in the case where the sensor is functioning correctly, external actions (vibration, for example) may affect the consumption article case and cause the consumption article within the consumption article case to move (to undulate, for example), and as a result detection may be performed a plurality of times.

In the case where the sensor has detected that the quantity of the consumption article within the consumption article case has become low and this detected result is utilized, various problems can occur when this detection is performed a plurality of times for the one consumption article case. For example, in the conventional technique described above, when the quantity of toner is detected by the sensor to be equal to or less than the predetermined quantity, the toner low signal is sent from the printer to the service center. If detection is performed a plurality of times for the one toner cartridge, the toner low signal is sent a plurality of times. In this case, even though one toner cartridge needs to be replenished, the situation will occur that a plurality of toner cartridges will be replenished. The present specification teaches a technique capable of dealing with the situation in which it is detected a plurality of times that the quantity of the consumption article within the consumption article case has become low.

The present specification teaches a function executing device for executing a function by utilizing a consumption article. The function executing device may comprise a device main body, a sensor, an information output device, and a controller. A consumption article housing case for housing the consumption article is to be mounted on the device main body. The sensor may detect the quantity of the consumption article within the consumption article housing case mounted on the device main body. The sensor may detect the quantity of the consumption article quantitatively, or may detect whether the quantity of the consumption article has fallen below a predetermined threshold (for example, less than a predetermined quantity below). The information output device may output information to the exterior in a case where the quantity of the consumption article within the consumption article housing case mounted on the device main body has become less than a predetermined quantity. Various contents may be adopted as this information. For example, the information may be a simple signal, may be the remaining quantity of the consumption article, may be the quantity of functions that are predicted to be capable of being executed from the remaining quantity of the consumption article (for example, the number of sheets of printing), or may be a message demanding that the consumption article housing case to be exchanged. The controller may control the information output device. The controller may prevent the information output device from outputting the information twice or more in a period between a time where the consumption article housing case is mounted on the device main body and a time where the consumption article housing case is dismounted from the device main body and a next consumption article housing ease is mounted on the device main body.

With the function executing device, the information is output to the exterior in the case where the quantity of the consumption article within the consumption article housing case has become low. However, in the case where detection of the low quantity of the consumption article is performed a plurality of times for the same consumption article housing case, information detected from the second time onward is prevented from being output to the exterior. That is, information is not output to the exterior a plurality of times even in the case where detection is performed a plurality of times for the same consumption article housing case.

DETAILED DESCRIPTION OF THE PREFERRED EMBODIMENT

First Embodiment

Figure 1:
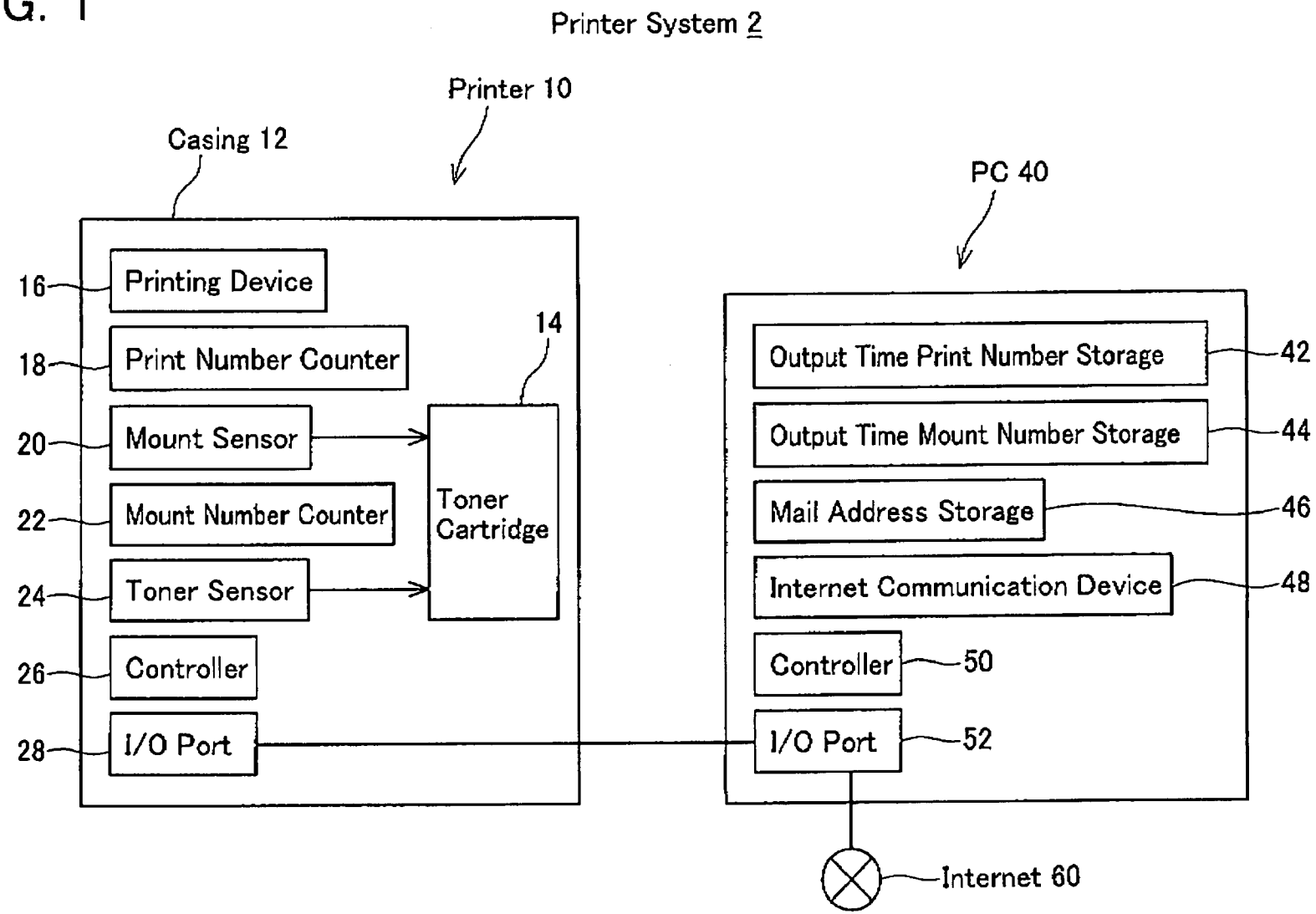
FIG. 1 shows a schematic view of a printer system of a first embodiment.

A first embodiment will be described with reference to figures. FIG. 1 shows the configuration of a printer system 2 of the present embodiment. The printer system 2 comprises a printer 10, a personal computer 40 (hereafter termed PC 40,) the internet 60, etc.

(Configuration of the Printer)

The printer 10 comprises a casing 12, a printing device 16, a print number counter 18, a mount sensor 20, a mount number counter 22, a toner sensor 24, a controller 26, and an I/O port 28. The casing 12 houses the devices 16 to 28. A toner cartridge 14 is mounted in a manner capable of removal on the casing 12. The toner cartridge 14 houses toner. The printing device 16 utilizes the toner housed in the toner cartridge 14 to print onto a print medium (printing paper or the like). The print number counter 18 counts and stores the number of sheets of the print medium (hereafter termed 'print number') printed by the printing device 16. The print number counter 18 accumulates and stores the print number. That is, the value of the print number counter 18 is not cleared.

The mount sensor 20 detects whether the toner cartridge 14 is mounted on the casing 12. The mount sensor 20 of the present embodiment has a known configuration (for example, the configuration taught in US Patent Application Publication No. 2006/0034625; the contents of which are hereby incorporated by reference into the present application). A description of the detailed configuration of the mount sensor 20 is omitted. The mount sensor 20 detects that a new toner cartridge 14 is mounted on the casing 12. The mount sensor 20 cannot detect that a used toner cartridge 14 (a toner cartridge 14 that has already been mounted on the casing 12) is mounted on the casing 12. The mount number counter 22 counts and stores the number of times a new toner cartridge 14 is mounted on the casing 12. The initial value of the mount number counter 22 is set to '0'. When the mount number counter 22 detects by means of the mount sensor 20 that a new toner cartridge 14 is mounted on the casing 12, the mount number counter 22 counts up by '1'.

The toner sensor 24 detects the quantity of toner in the toner cartridge 14. The toner sensor 24 normally outputs either a high state or a low state to the controller 26. In the case where the quantity of toner in the toner cartridge 14 is greater than a predetermined quantity, the toner quantity sensor 24 outputs the high state, and in the case where the quantity of toner in the toner cartridge 14 is equal to or less than the predetermined quantity, the toner quantity sensor 24 outputs the low state. The toner quantity sensor 24 of the present embodiment has a known configuration (for example, the configuration taught in US Patent Application Publication No. 2006/0034625). A description of the detailed configuration of the toner sensor 24 is omitted.

The controller 26 performs various processes in accordance with programs that have been set in advance, and exerts general control over the operation of the printer 10. The contents of the processes executed by the controller 26 will be described in detail later. The I/O port 28 is connected with the PC 40. The I/O port 28 is capable of outputting information to the PC 40. The I/O port 28 is capable of inputting information output from the PC 40. The contents of this information will be described in detail later.

(Configuration of the PC)

The PC 40 comprises an output time print number storage 42, an output time mount number storage 44, a mail address storage 46, an internet communication device 48, a controller 50, and an I/O port 52. The output time print number storage 42 stores the print number that is being stored by the print number counter 18 when a warning mail (to be described) is output. The output time mount number storage 44 stores the mount number that is being stored by the mount number counter 22 when the warning mail is output. The mail address storage 46 stores an email address of a destination of the warning mail. In the present embodiment, the mail address storage 46 stores the email address of an administrator (for example, a supplier) who exchanges the toner cartridge 14. The internet communication device 48 executes internet communication (for example, sending and receiving email) in accordance with a command from the controller 50.

The controller 50 performs various processes in accordance with programs that have been set in advance, and exerts general control over the operation of the PC 40. The contents of the processes executed by the controller 50 will be described in detail later. The I/O port 52 is connected with the printer 10. The I/O port 52 is capable of outputting information to the printer 10. The I/O port 52 is capable of inputting information output from the printer 10. The contents of this information will be described in detail later. Further, the I/O port 52 is connected with the internet 60.

(Process of the Printer)

Figure 2:
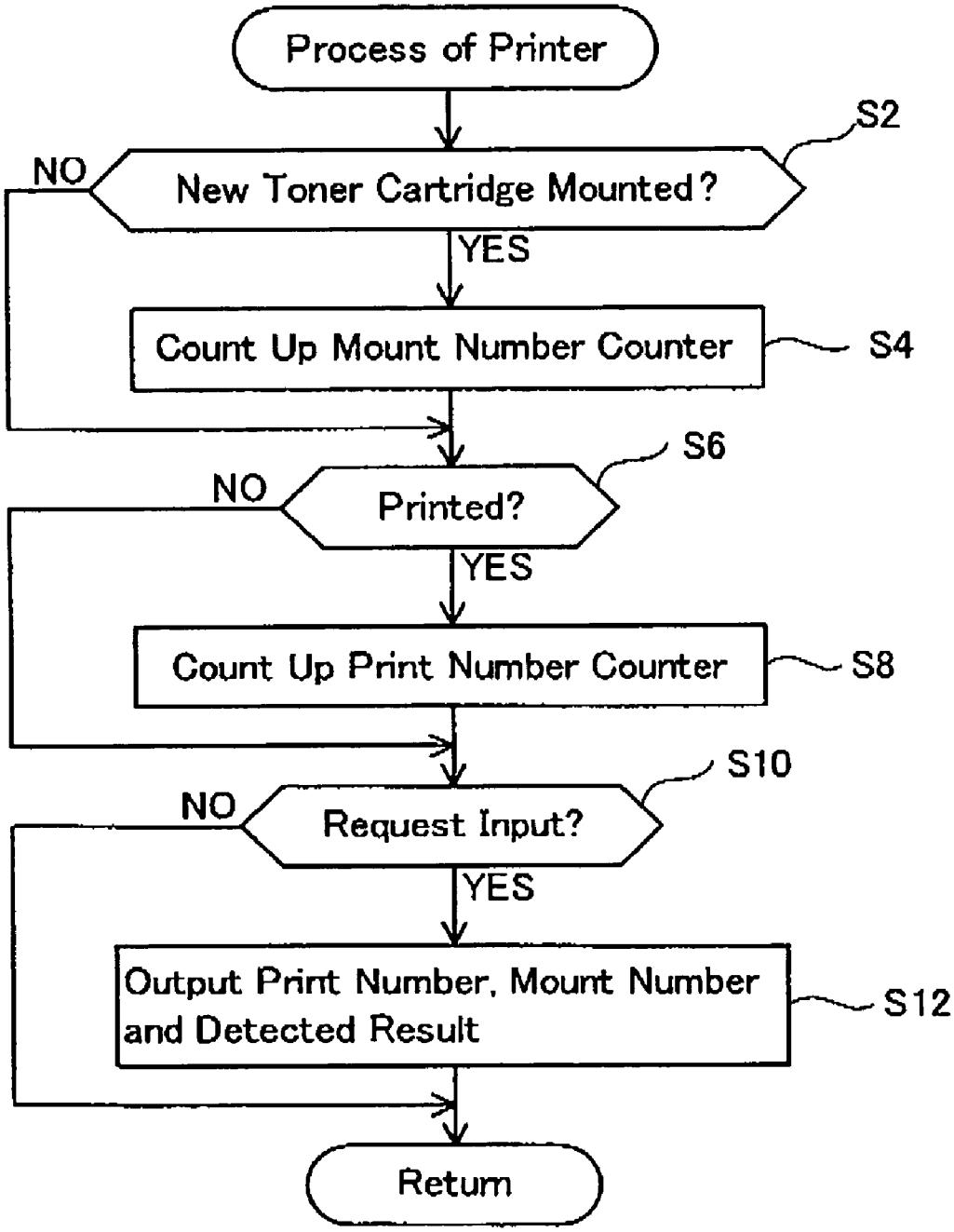
FIG. 2 shows a flow chart of a process executed by a printer.

Next, the process executed by the printer 10 will be described. FIG. 2 shows a flow chart of the process executed by the printer 10. Moreover, only the process relating to the present technique is shown in this flow chart. Processes not closely related to the present technique have not been shown. The process of FIG. 2 is executed by the controller 26 of the printer 10. The controller 26 monitors whether a new toner cartridge 14 is mounted (S2). In the case where this has been detected by the mount sensor 20, the controller 26 determines YES in S2. In this case, the controller 26 causes the mount number counter 22 to count up by '1' (S4). When S4 ends, the process proceeds to S6. In the case where S2 is NO, also, the process proceeds to S6. In the present embodiment, a configuration has been adopted in which the controller 26 causes the mount number counter 22 to count up. However, a configuration may equally well be adopted in which the mount number counter 22 counts up automatically.

In S6, the controller 26 monitors the execution of printing. In the case where printing has been executed by the printing device 16, the controller 26 determines YES in S6. In this case, the controller 26 causes the print number counter 18 to count up by '1' (S8). The print number counter 18 counts up each time one sheet of print medium is printed. When S8 ends, the process proceeds to S10. In the case where S6 is NO, also, the process proceeds to S10. In the present embodiment, a configuration has been adopted in which the controller 26 causes the print number counter 18 to count up. However, a configuration may equally well be adopted in which the print number counter 18 counts up automatically.

In S10, the controller 26 monitors the input of an information request from the PC 40. This information request is output periodically from the PC 40. In the case where the information request from the PC 40 has been input to the I/O port 28, the controller 26 determines YES in S10. In this case, the controller 26 outputs the following to the PC 40 (S12): the print number being stored in the print number counter 18, the mount number being stored in the mount number counter 22, and the detected result from the toner sensor 24 (high state or low state). When S12 ends, the process returns to S2. In the case where S10 is NO, also, the process returns to S2.

(Process of the PC)

Figure 3:
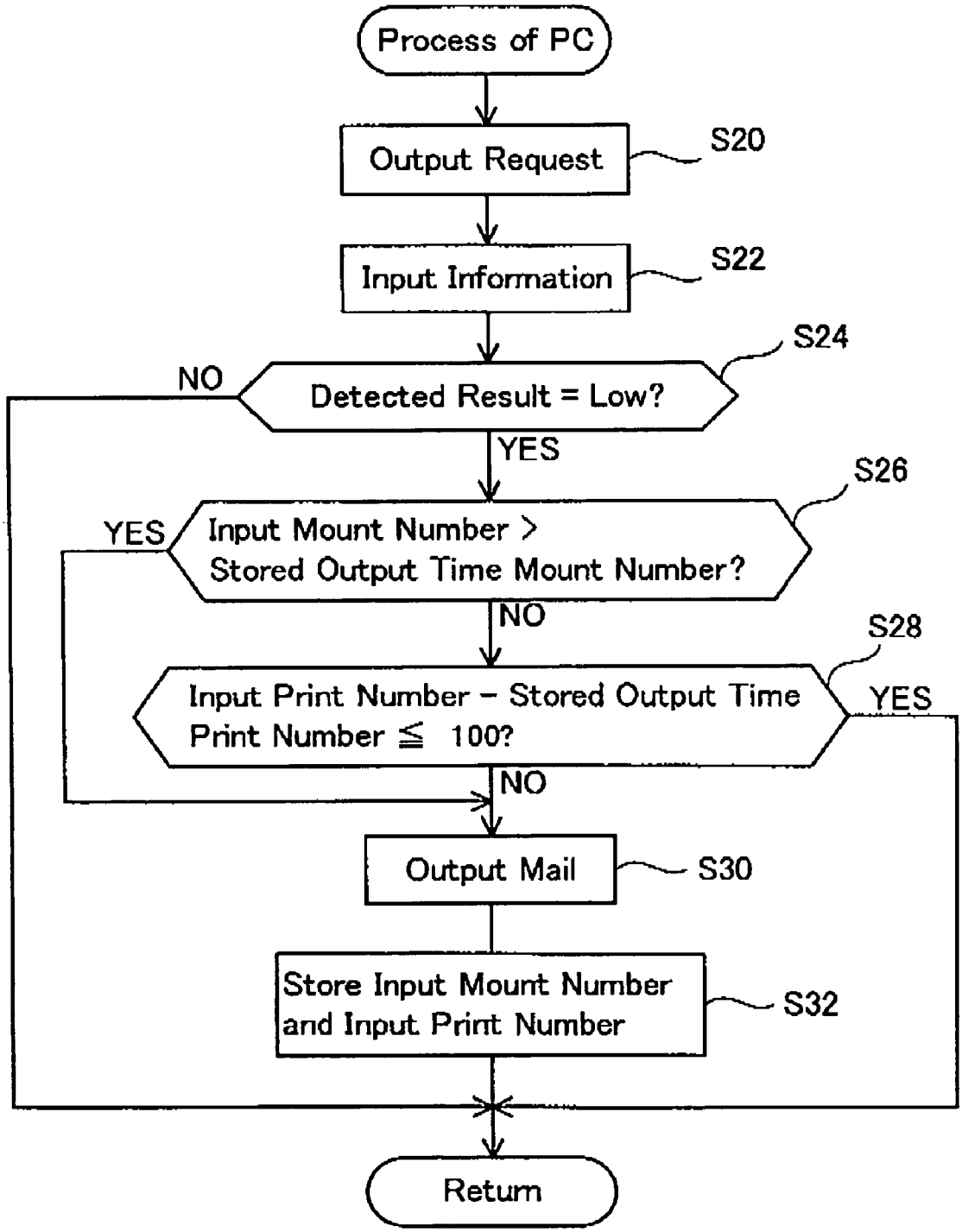
FIG. 3 shows a flow chart of a process executed by a PC

Next, the process executed by the PC 40 will be described. FIG. 3 shows a flow chart of the process executed by the PC 40. Moreover, only the process relating to the present technique is shown in this flow chart. Processes not closely related to the present technique have not been shown. The process of FIG. 3 is executed by the controller 50 of the PC 40. The controller 50 outputs the information request to the printer 10 (S20). As a result, the print number, the mount number, and the detected result from the toner sensor 24 are output from the printer 10 in S12 of FIG. 2. The print number, the mount number, and the detected result from the toner sensor 24 are input to the I/O port 52 (S22).

Next, the controller 50 determines whether the detected result from the toner sensor 24 input in S22 is low state (S24). In the case where S24 is YES, the process proceeds to S26. In the case where S24 is NO, the subsequent processes are skipped and the process returns to S20. In S26, the controller 50 compares the mount number input in S22 with the output time mount number being stored in the output time mount number storage 44. In the case where the former and the latter are the same, the process proceeds to S28. In the case where the former is greater than the latter, S28 is skipped and the process proceeds to S30. In S28, the controller 50 subtracts the output time print number being stored in the output time print number storage 42 from the print number input in S22. The controller 50 determines whether the value obtained by this subtraction process is less than or equal to 100. In the case where S28 is YES, S30 and S32 are skipped and the process returns to S20. In the case where S28 is NO, the process proceeds to S30.

In S30, the controller 50 outputs the warning mail to the email address being stored in the mail address storage 46. The warning mail contains a message that the toner quantity in the toner cartridge 14 has become low. As a result, the administrator who exchanges the toner cartridges 14 can learn that the toner cartridge 14 needs to be exchanged. Next, the controller 50 clears the stored contents in the output time mount number storage 44, and stores the mount number that was input in S22 therein (S32). A new output time mount number is thus stored in the output time mount number storage 44. Further, the controller 50 clears the stored contents in the output time print number storage 42, and stores the print number that was input in S22. A new output time print number is thus stored in the output time print number storage 42. When S32 ends, the process returns to S20.

The printer system 2 of the present embodiment has been described in detail. For example, in the case where the new toner cartridge 14 has been mounted on the printer 1 for the first time, the mount number of the mount number counter 22 becomes '1'. The output time mount number of the output time mount number storage 44 remains '0'. In the case where, in this state, the low state is detected by the toner sensor 24, the controller 50 of the PC 40 outputs the warning mail. At this juncture, '1' is stored in the output time mount number storage 44. That is, the output time mount number becomes '1'. Since the mount number and the output time mount number are both '1' even if the low state is detected again by the toner sensor 24, NO is determined in S26 of FIG. 3. In this case, as long as NO is not determined in S28, the warning mail is not output to the exterior. In the case where the toner cartridge 14 has been exchanged for a next toner cartridge 14, the mount number becomes '2' (and the output time mount number remains '1'). In the case where, in this state, the low state is detected by the toner sensor 24, the controller 50 outputs the warning mail. At this juncture, the output time mount number becomes '2' (and the mount number remains '2'). Unless NO is determined in S28, the warning mail is not output to the exterior even if the low state is detected again by the toner quantity sensor 24. By adopting the present system 2, it is possible to prevent the warning mail being output to the exterior a plurality of times for one toner cartridge 14 even in the case where the toner quantity sensor 24 has determined the low state a plurality of times. As a result, it is possible to prevent the situation from occurring in which a plurality of toner cartridges 14 is replenished even though only one toner cartridge 14 needs to be replenished.

As described above, the mount sensor 20 cannot detect that a used toner cartridge 14 is mounted. In the present embodiment, the warning mail is output even in the case where a used toner cartridge 14 has been mounted and the toner quantity thereof has become low. That is, in the case where the low state is detected by the toner sensor 24 while the mount number and the output time mount number are the same, the print number since the previous warning mail was output is checked (S28). If the print number is equal to or greater than 100 sheets (S28 is NO), it is determined that the toner quantity has become low due to a used toner cartridge 14 having been mounted and printing having been executed, and the warning mail is output. With the present embodiment, it is possible to prevent the situation from occurring in which the warning mail is not output even though the used toner cartridge 14 needs to be exchanged.

The output time mount number that is being stored in the output time mount number storage 44 could also be termed a 'number of times a warning mail is output for a new toner cartridge 14'. Consequently, the output time mount number storage 44 could also be termed a 'warning mail output number storage'. The process of the controller 50 does not change irrespective of which terms are used, and the effects above can be obtained.

Second Embodiment

Figure 4:
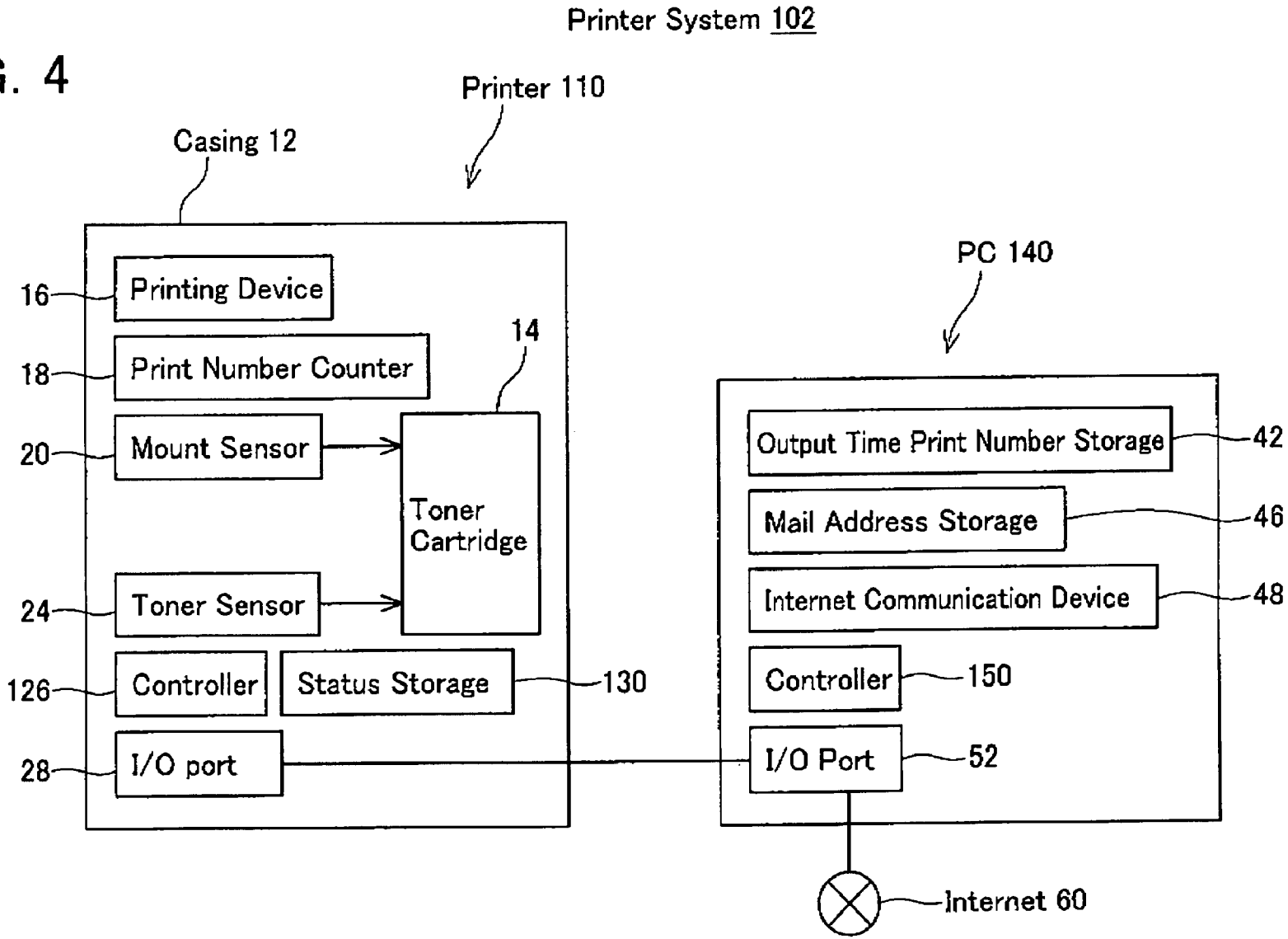
FIG. 4 shows a schematic view of a printer system of a second embodiment.

A second embodiment will now be described. The description will concentrate on points that differ from the first embodiment. FIG. 4 shows the configuration of a printer system 102 of the present embodiment. The printer system 102 comprises a printer 110, a PC 140, etc. The printer 110 of the present embodiment is not provided with the mount number counter 22 (see FIG. 1). A status storage 130 is added to the printer 110. The status storage 130 stores either a flag '0' or a flag '1'. When the mount sensor 20 has detected that a new toner cartridge 14 has been mounted, the status storage 130 stores the flag '0'. When the warning mail is output from the PC 140, the status storage 130 stores the flag '1'. A controller 126 of the present embodiment executes a process that differs from that of the first embodiment. The contents of this process will be described in detail later. The PC 140 of the present embodiment is not provided with the output time mount number storage 44 (see FIG. 1). A controller 150 of the present embodiment executes a process that differs from that of the first embodiment. The contents of this process will be described in detail later.

(Process of the Printer)

Figure 5:
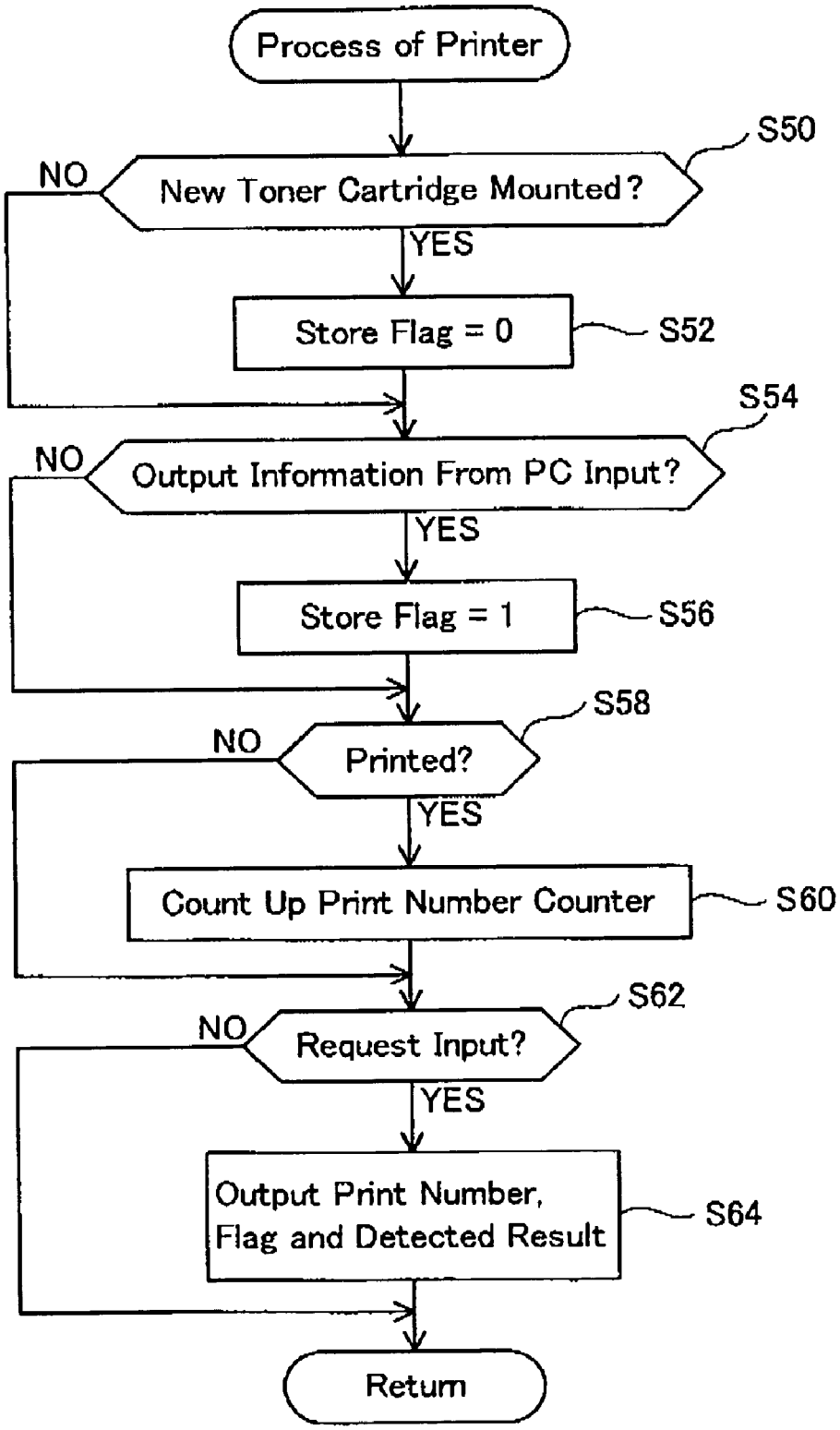
FIG. 5 shows a flow chart of a process executed by a printer

A process executed by the printer 110 will be described. FIG. 5 shows a flow chart of the process executed by the printer 110. The process of FIG. 5 is executed by the controller 126 of the printer 110. The controller 126 monitors whether a new toner cartridge 14 has been mounted (S50). This process is the same as S2 of FIG. 2. In the case where S50 is YES, the controller 126 stores the flag '0' in the status storage 130 (S52). When S52 ends, the process proceeds to S54. In the case where S50 is NO, also, the process proceeds to S54. In S54, the controller 126 monitors whether information showing the warning mail having been output (hereafter termed 'output information') has been sent from the PC 140. In the case where the output information from the PC 140 has been input to the I/O port 28, the controller 126 determines YES in S54. In this case, the controller 126 stores the flag '1' in the status storage 130 (S56). When S56 ends, the process proceeds to S58. In the case where S54 is NO, also, the process proceeds to S58.

The processes from S58 to S62 are the same as S6 to S10 of FIG. 1. A description of these processes has been omitted. In the case where S62 is YES, the controller 126 outputs the following to the PC 140 (S64): the print number being stored in the print number counter 18, the flag '0' or '1' being stored in the status storage 130, and the detected result from the toner sensor 24 (high state or low state). When S64 ends, the process returns to S50.

(Process of the PC)

Figure 6:
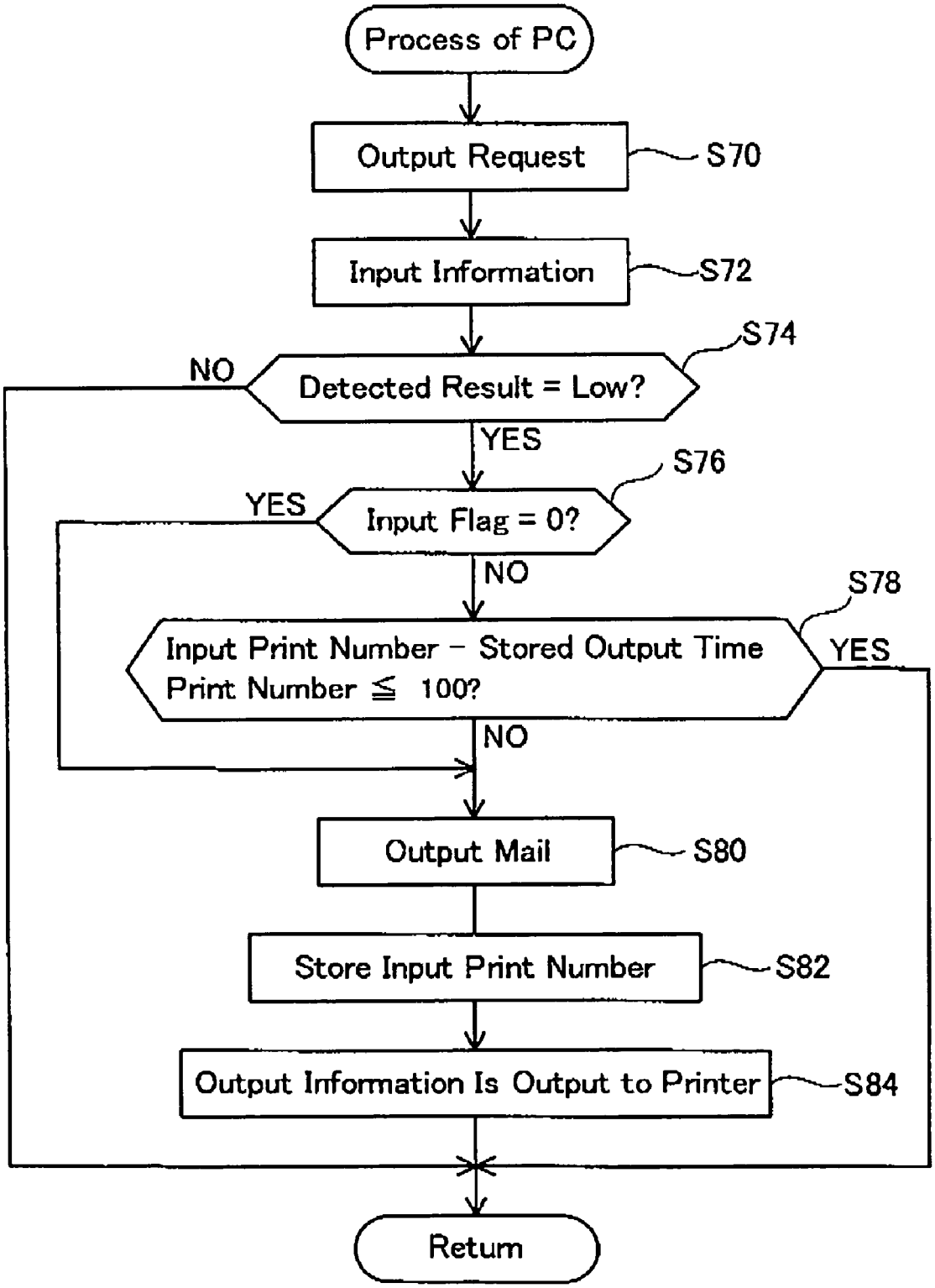
FIG. 6 shows a flow chart of a process executed by a PC.

Next, the process executed by the PC 140 will be described. FIG. 6 shows a flow chart of the process executed by the PC 140. The process of FIG. 6 is executed by the controller 150 of the PC 140. The controller 150 outputs the information request to the printer 110 (S70). As a result, the print number, the flag, and the detected result from the toner sensor 24 are output from the printer 110 in S64 of FIG. 5. The print number, the flag, and the detected result from the toner sensor 24 are input to the I/O port 52 (S72).

Next, the controller 150 determines whether the detected result from the toner quantity sensor 24 input in S72 is low state (S74). In the case where S74 is YES, the process proceeds to S76. In the case where S74 is NO, the subsequent processes are skipped and the process returns to S70. In S76, the controller 150 determines whether the flag input in S72 is '0'. In the case where S76 is NO, the process proceeds to S78. In the case where S76 is YES, S78 is skipped and the process proceeds to S80. The process of S78 is the same as S28 of FIG. 3. In the case where S78 is YES, S80 to S84 are skipped and the process returns to S70. In the case where S78 is NO, the process proceeds to S80.

The process of S80 is the same as S30 of FIG. 3. Next, the controller 150 clears the stored contents in the output time print number storage 42, and stores the print number that was input in S72 therein (S82). Next, the controller 150 outputs the output information to the printer 110 (S84). As a result, the flag '1' is stored in the status storage 130 in S56 of FIG. 5.

In the case for example where the new toner cartridge 14 has been mounted on the printer 110 for the first time, the flag of the status storage 130 becomes '0' (see S52 of FIG. 5). In the case where, in this state, the low state is detected by the toner sensor 24, the controller 150 of the PC 140 outputs the warning mail. The flag of the status storage 130 becomes '1' (see S56 of FIG. 5) when the warning mail is output. Since the flag is '1' even if the low state is detected again by the toner sensor 24, NO is determined in S76 of FIG. 6. In this case, as long as NO is not determined in S78, the warning mail is not output to the exterior. By adopting the present system 102, as well, it is possible to prevent the warning mail being output to the exterior a plurality of times for one toner cartridge 14 in the case where the toner sensor 24 has determined the low state a plurality of times. As a result, it is possible to prevent the situation from occurring in which a plurality of the toner cartridges 14 is replenished even though only one toner cartridge 14 needs to be replenished.

Third Embodiment

Figure 7:
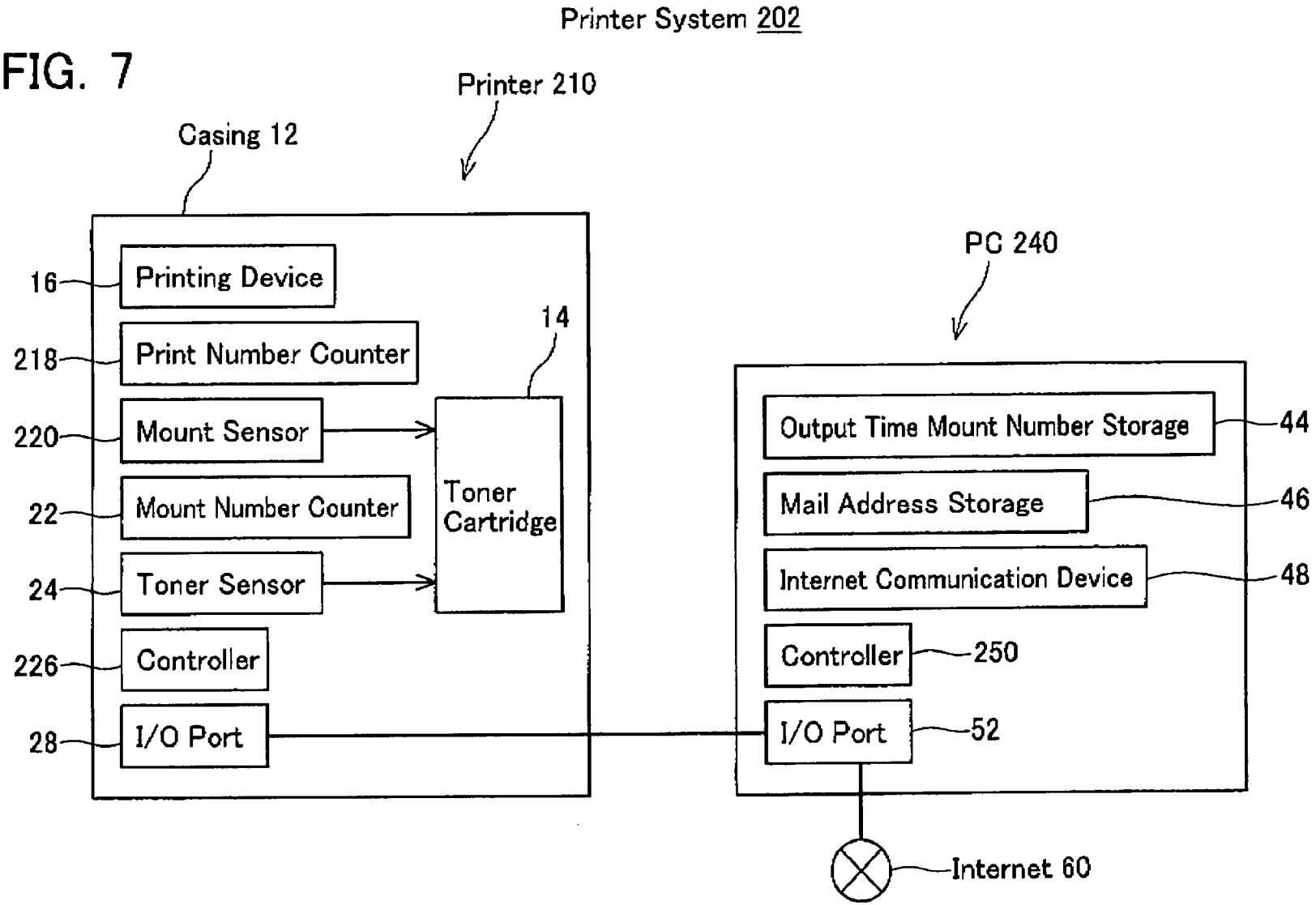
FIG. 7 shows a schematic view of a printer system of a third embodiment.

A third embodiment will now be described. The description will concentrate on points that differ from the first embodiment. FIG. 7 shows the configuration of a printer system 202 of the present embodiment. The printer system 202 comprises a printer 210, a PC 240, etc. A print number counter 218 of the printer 210 does not accumulate and count a print number. A count value is cleared in the print number counter 218 when the toner cartridge 14 is mounted. That is, the print number counter 218 counts and stores the number of sheets printed by the printing device 16 since the toner cartridge 14 has been mounted. Further, a mount sensor 220 of the present embodiment is capable of determining whether a new or an old toner cartridge 14 has been mounted. The mount sensor 220 that has this function is taught in US Patent Application Publication No. 2006/0034625. A controller 226 of the present embodiment executes a process that differs from that of the first embodiment. The contents of this process will be described in detail later. The PC 240 of the present embodiment is not provided with the output time print number storage 42 (see FIG. 1). A controller 250 of the present embodiment executes a process that differs from that of the first embodiment. The contents of this process will be described in detail later.

(Process of the Printer)

Figure 8:
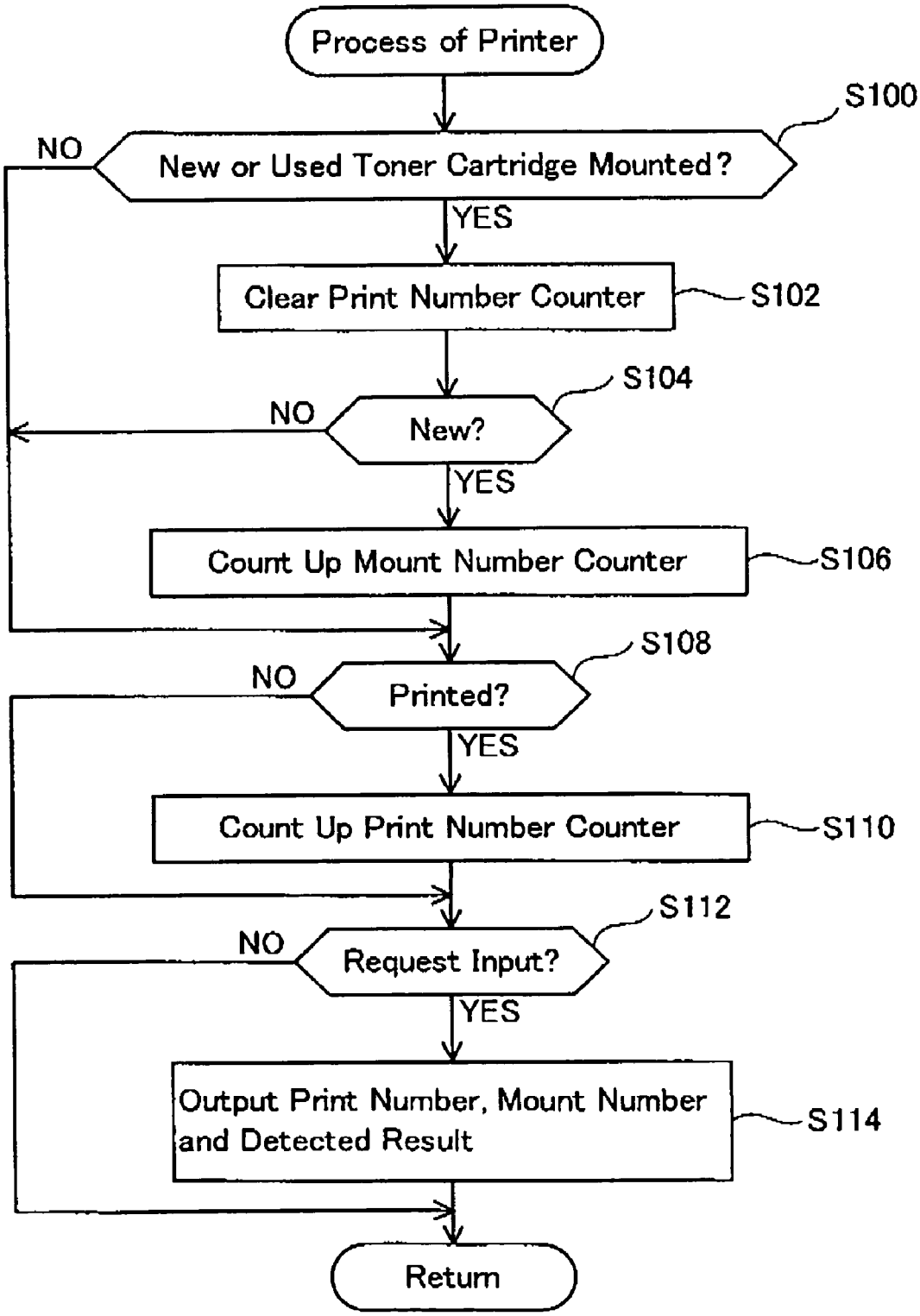
FIG. 8 shows a flow chart of a process executed by a printer.

A process executed by the printer 210 will be described. FIG. 8 shows a flow chart of the process executed by the printer 210. The process of FIG. 8 is executed by the controller 226 of the printer 210. The controller 226 monitors whether a new or a used toner cartridge 14 has been mounted (S100). In the case either toner cartridge 14 has been mounted, YES is determined in S100. In the case where S100 is YES, the controller 226 clears the print number counter 218 (S102). Next, the controller 226 determines whether a new toner cartridge 14 has been mounted (S104). In the case where a new toner cartridge 14 has been mounted, YES is determined in S104, and the process proceeds to S106. In S106, the controller 226 causes the mount number counter 22 to count up. This process is the same as S4 of FIG. 2. In the case where a used toner cartridge 14 has been mounted, NO is determined in S104, S106 is skipped, and the process proceeds to S108. The processes from S108 to S114 are the same as S6 to S12 of FIG. 2. A description of these processes is omitted.

(Process of the PC)

Figure 9:
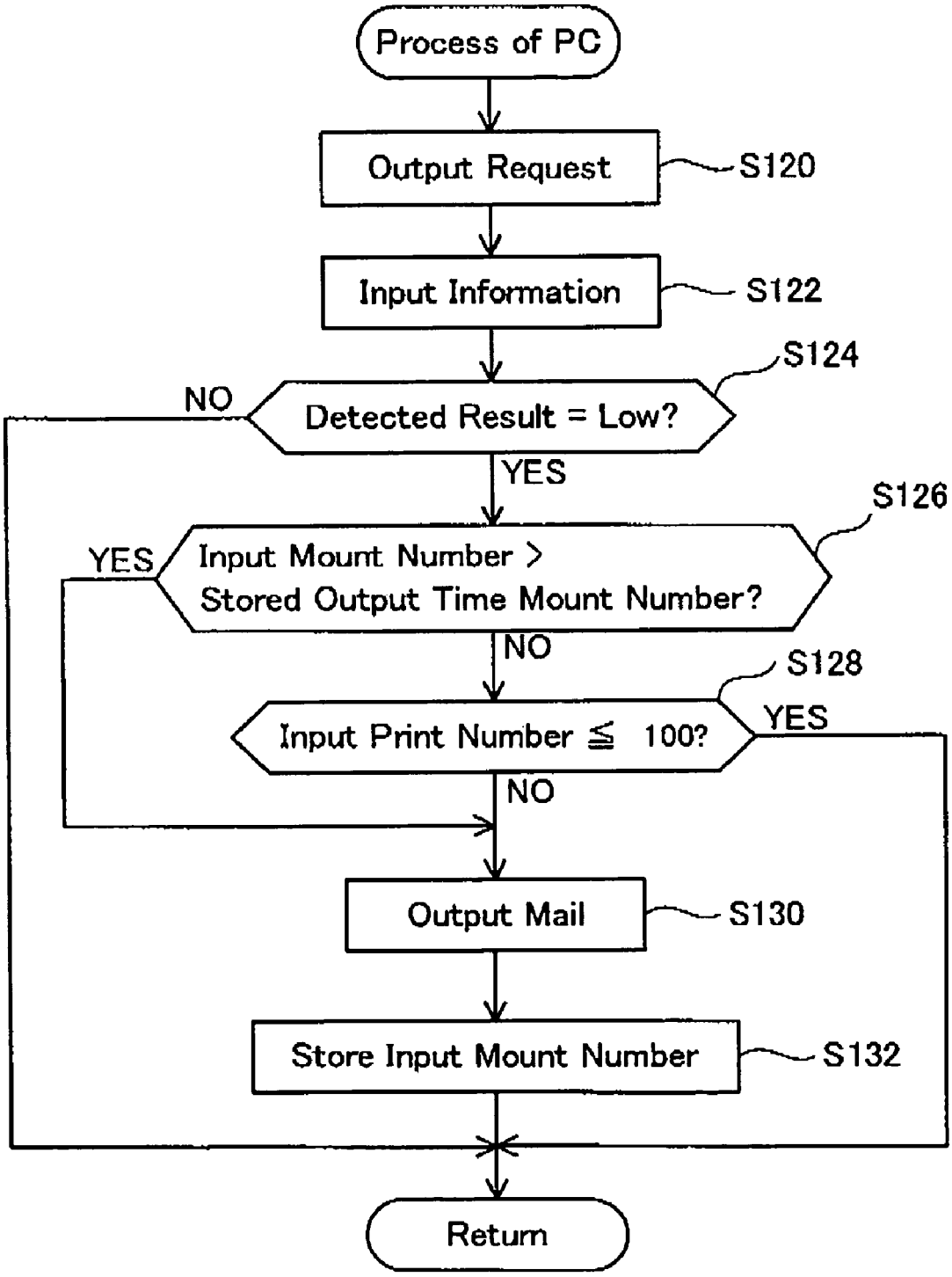
FIG. 9 shows a flow chart of a process executed by a PC.

Next, the process executed by the PC 240 will be described. FIG. 9 shows a flow chart of the process executed by the PC 240. The process of FIG. 9 is executed by the controller 250 of the PC 240. The processes from S120 to S126 are the same as S20 to S26 of FIG. 3. In S128, the controller 250 determines whether the print number (the print number since the toner cartridge 14 has been mounted) input in S122 is less than 100 sheets. In the case where S128 is YES, S130 and S132 are skipped, and the process returns to S120. In the case where S128 is NO, the controller 250 outputs the warning mail (S130). Furthermore, the controller 250 clears the stored contents of the output time mount number storage 44, and causes the mount number input in S122 to be stored therein (S132). When S132 ends, the process returns to S120.

By adopting the present embodiment, as well, the warning mail is output in the case where a used toner cartridge 14 has been mounted and the toner quantity thereof has become low. That is, in the case where the low state has been detected by the toner sensor 24 while the mount number and the output time mount number are the same, the print number since the toner cartridge 14 was last mounted is checked (S128). If the print number is equal to or greater than 100 sheets (S128 is NO), it is determined that the toner quantity has become low due to a used toner cartridge 14 having been mounted and printing having been executed, and the warning mail is output. With the present embodiment, it is possible to prevent the situation from occurring in which the warning mail is not output even though the used toner cartridge 14 needs to be exchanged.

Some characteristics of the technique taught in the above embodiments will be set forth. A function executing device may comprise a first storage device that stores a number of consumption article housing cases that have been mounted on the device main body, and a second storage device that stores the number being stored in the first storage device when the information output device outputs the information. In this case, the controller may control the information output device such that the information output device outputs the information in a case where a condition described below is satisfied:

(1) the quantity of the consumption article within the consumption article housing case mounted on the device main body has become less than the predetermined quantity; and (2) the number stored in the first storage device is greater than the number stored in the second storage device.

In the case for example where the consumption article housing case is mounted on the device main body for the first time, the number of times of mounting (may be termed 'mount number' hereafter) stored in the first storage device becomes '1'. The number of times stored in the second storage device (may be termed 'output time mount number' hereafter) remains '0' That is, the condition (2) described above is satisfied. In the case where detection of the low quantity of the consumption article is performed in this state (in the case where the condition (1) described above is satisfied), the controller controls the information output device such that the information output device outputs the information to the exterior. The mount number at this juncture is '1', and this value is stored in the second storage device. That is, the output time mount number becomes '1' (and the mount number remains '1'). If detection is again performed in this state, both the mount number and the output time mount number are '1' and do not satisfy the above condition (2), and consequently the information is not output to the exterior. In the case where the consumption article housing case is dismounted from the device main body and a next consumption article housing case is mounted, the mount number becomes '2' (and the output time mount number remains '1'), and the above condition (2) is again satisfied. In the case where detection is performed in this state, the controller controls the information output device such that the information output device outputs the information to the exterior. The output time mount number becomes '2' at this juncture (and the mount number remains '2'). Even if detection is again performed in this state, the above condition (2) is not satisfied, and consequently the information is not output to the exterior. When the above configuration is adopted, it is possible to prevent the information being output to the exterior a plurality of times for one consumption article housing case.

The initial value of the first storage device does not necessarily have to be '0'. Further, in the case where the consumption article housing case has been mounted on the device main body, the mount number of the first storage device may be counted up only by '1', or may equally well be counted up by another number. That is, the interval of counting up can be set freely. Further, in the case where one consumption article housing case has been mounted on the device main body, the mount number of the first storage device may equally well count down. In this case, the above condition (2) is changed to: 'the number stored in the first storage device is smaller than the number stored in the second storage device'. However, this case is the same for realizing the present technique.

The function executing device may be configured by only one machine (for example, a printer), or may be configured by two or more separate machines. In the latter case, the function executing device may for example be configured by a printer and an information processing device to be connected to the printer. In this case, the function executing device may equally well be called a function executing system. The printer may comprise the device main body, the sensor, the first storage device, a printing device that prints on a print medium by utilizing the consumption article, and a printer side output device that outputs the number stored in the first storage device and a detected result of the sensor to the information processing device. The information processing device may comprise the information output device, the controller, the second storage device, and an input device that inputs the number and the detected result output from the printer.

The first storage device may count the mount number when either a new or a used consumption article housing case has been mounted on the device main body, or may count the mount number only when a new consumption article housing case has been mounted on the device main body. In the latter case, the following situation may occur. If for example a used consumption article housing case is mounted on the device main body while both the mount number and the output time mount number are '10', the mount number does not count up, and consequently the mount number remains '10' (the output time mount number also remains '10'). In this state, the consumption article (for example, toner or ink) in the consumption article housing case continues to be utilized in printing. Since both the mount number and the output time mount number are '10', the information is not output even if the consumption article quantity has become less than the predetermined quantity. The information is not output even though the used consumption article housing case mounted on the device main body needs to be exchanged. In order to deal with this situation, Configuration 1 or Configuration 2 below may be adopted.

(Configuration 1) The function executing device may further comprise a third storage device that stores a number of print media that have been printed by the printing device after the information output device has output the information. The third storage device may for example clear the count value when the information was output and count the number of print media printed thereafter. Further, the third storage device may for example comprise a counter that counts the print number, and an output time count value storage that stores the count value that is being stored in the counter when the information is output. In this case, the number of print media printed by the printing device after the information was output may be obtained by subtracting the output time count value being stored in the output time count value storage from the count value of the counter. The controller may control the information output device such that the information output device outputs the information in the case where a condition described below is satisfied:

(1) the quantity of the consumption article within the consumption article housing case mounted on the device main body has become less than the predetermined quantity;

(2) the number stored in the first storage device is equal to the number stored in the second storage device; and (3) the number stored in the third storage device is greater than a predetermined number.

With the Configuration 1, the number of print media that have been printed since the information was last output is checked in the case where detection of the low quantity of the consumption article is performed while the mount number and the output time mount number are the same. In the case where the number of print media is greater than the predetermined number, it is determined that the consumption article quantity has become low due to a used consumption article housing case having been mounted and printing having been executed, and the information is output. With this configuration, it is possible to prevent the situation from occurring in which the information is not output even though the used consumption article housing case needs to be exchanged. Moreover, in Configuration 1, the controller may prevent the information from being output in the case where the number stored in the third storage device is less than the predetermined number.

(Configuration 2) The function executing device may further comprise a fourth storage device that stores a number of print media that have been printed by the printing device after the consumption article housing case was mounted on the device main body. The fourth storage device may clear the count value when the consumption article housing case is mounted on the device main body, and count the number of print media that are printed thereafter. Further, the fourth storage device may comprise a counter that counts the print number, and a mount time count value storage that stores the count value that is being stored in the counter when the consumption article housing case is mounted on the device main body. The controller may control the information output device such that the information output device outputs the information in a case where a condition described below is satisfied:

(1) the quantity of the consumption article within the consumption article housing case mounted on the device main body has become less than the predetermined quantity;

(2) the number stored in the first storage device is equal to the number stored in the second storage device; and (3) the number stored in the fourth storage device is greater than a predetermined number.

With the Configuration 2, the number of print media that have been printed since the consumption article housing case was mounted on the device main body is checked in the case where detection of the low quantity of the consumption article is performed while the mount number and the output time mount number are the same. In the case where the number of print media is greater than the predetermined number, it is determined that the consumption article quantity has become low due to a used consumption article housing case having been mounted and printing having been executed, and the information is output. With this configuration, it is possible to prevent the situation from occurring in which the information is not output even though the used consumption article housing case needs to be exchanged. Moreover, in Configuration 2, the controller may prevent the information from being output in the case where the number stored in the fourth storage device is less than the predetermined number.

The output time mount number may also be called the number of times the information was output (information output number). That is, the function executing device may further comprise a first storage device that stores a number of consumption article housing cases that have been mounted on the device main body, and a fifth storage device that stores the information output number. The controller may control the information output device such that the information output device outputs the information in a case where a condition described below is satisfied:

(1) the quantity of the consumption article within the consumption article housing case mounted on the device main body has become less than the predetermined quantity; and (2) the number stored in the first storage device is greater than the output number stored in the fifth storage device.

In the case for example where the consumption article housing case has been mounted on the device main body for the first time, the mount number becomes '1'. The information output number remains '0'. That is, the condition (2) described above is satisfied. In the case where detection of the low quantity of the consumption article is performed in this state (in the case where the condition (1) described above is satisfied), the information is output to the exterior. At this juncture, the information output number becomes '1' (and the mount number remains '1'). If detection is again performed in this state, both the mount number and the information output number are '1' and do not satisfy the above condition (2), and consequently the information is not output to the exterior. In the case where the consumption article housing case is dismounted from the device main body and a next consumption article housing case is mounted, the mount number becomes '2' (and the information output number remains '1'), and the above condition (2) is again satisfied. In the case where detection is performed in this state, the information is output to the exterior. The information output number becomes '2' at this juncture (and the mount number remains '2'). Even if detection is again performed in this state, the above condition (2) is not satisfied, and consequently the information is not output to the exterior. When the above configuration is adopted, as well, it is possible to prevent the information being output to the exterior a plurality of times for one consumption article housing case.

The initial value of the first storage device and/or the fifth storage device does not necessarily have to be '0' but can be set freely. Further, the interval of counting up (or counting down) of the mount number and/or the interval of counting up (or counting down) of the information output number does not necessarily have to be '1', but can be set freely.

The function executing device may further comprise the printing device and the third storage device. The controller may control the information output device such that the information output device outputs the information in the case where a condition described below is satisfied:

(1) the quantity of the consumption article within the consumption article housing case mounted on the device main body has become less than the predetermined quantity;

(2) the number stored in the first storage device is equal to the output number stored in the fifth storage device; and (3) the number stored in the third storage device is greater than a predetermined number.

With this configuration, it is possible to prevent the situation from occurring in which the information is not output even though the used consumption article housing case needs to be exchanged.

The function executing device may further comprise the printing device and the fourth storage device. The controller may control the information output device such that the information output device outputs the information in a case where a condition described below is satisfied:

(1) the quantity of the consumption article within the consumption article housing case mounted on the device main body has become less than the predetermined quantity;

(2) the number stored in the first storage device is equal to the output number stored in the fifth storage device; and (3) the number stored in the fourth storage device is greater than a predetermined number.

With this configuration, it is possible to prevent the situation from occurring in which the information is not output even though the used consumption article housing case needs to be exchanged.

When the following configuration is adopted, as well, it is possible to prevent the information being output to the exterior a plurality of times for one consumption article housing case. That is, the function executing device may further comprise a status storage device that stores either a first status or a second status. The status storage device may store the second status in a case where a consumption article housing case is mounted on the device main body while the first status is being stored. The status storage device may store the first status in a case where the information output device outputs the information while the second status is being stored. The status storage device may store the second status in a case where either a new or a used consumption article housing case is mounted on the device main body, or may store the second status only in a case where a new consumption article housing case is mounted on the device main body. The controller may control the information output device such that the information output device outputs the information in a case where a condition described below is satisfied:

(1) the quantity of the consumption article within the consumption article housing case mounted on the device main body has become less than the predetermined quantity; and (2) the second status is being stored in the status storage device.

In the case for example where the consumption article housing case has been mounted on the device main body for the first time, the second status is stored. That is, the condition (2) described above is satisfied. In the case where detection of the low quantity of the consumption article is performed in this state (in the case where the condition (1) described above is satisfied), the information is output to the exterior. At this juncture, the first status is stored. If detection is again performed in this state, since the first status is being stored, this does not satisfy the above condition (2), and consequently the information is not output to the exterior. In the case where the consumption article housing case is dismounted from the device main body and a next consumption article housing case is mounted, the second status is stored, and the above condition (2) is again satisfied. In the case where detection is performed in this state, the information is output to the exterior. The first status is stored at this juncture. Even if detection is again performed in this state, the above condition (2) is not satisfied, and consequently the information is not output to the exterior. When the above configuration is adopted, as well, it is possible to prevent the information being output to the exterior a plurality of times for one consumption article housing case.

The contents stored as the status include various formats. For example, '0' may be stored as the first status and '1' may be stored as the second status. Further, a status that is for example the combination of two numbers may be stored. For example, for the first status, two numbers may be stored such that the difference between the two numbers is '0' and, for the second status, two numbers may be stored such that the difference between the two numbers is '1'. Furthermore, the status storage device may be a predetermined memory area that stores '1' and '0', or may be a switch located between the sensor and the controller. This switch may relay (or not relay) when the quantity of the consumption article has become equal to or less than the predetermined quantity, and may not relay (or relay) when the quantity of the consumption article is greater than the predetermined quantity.

The function executing device may further comprise the printing device and the third storage device. The status storage device may store the second status in a case where a new consumption article housing case is mounted on the device main body while the first status is being stored. The status storage device may not store the second status in a case where a used consumption article housing case is mounted on the device main body while the first status is being stored. The controller may control the information output device such that the information output device outputs the information in the case where a condition described below is satisfied:

(1) the quantity of the consumption article within the consumption article housing case mounted on the device main body has become less than the predetermined quantity;

(2) the first status is being stored in the status storage device; and (3) the number stored in the third storage device is greater than a predetermined number.

With this configuration, it is possible to prevent the situation from occurring in which the information is not output even though the used consumption article housing case needs to be exchanged.

The function executing device may further comprise the printing device and the fourth storage device. The status storage device may store the second status in a case where a new consumption article housing case is mounted on the device main body while the first status is being stored. The status storage device may not store the second status in a case where a used consumption article housing case is mounted on the device main body while the first status is being stored. The controller may control the information output device such that the information output device outputs the information in a case where a condition described below is satisfied:

(1) the quantity of the consumption article within the consumption article housing case mounted on the device main body has become less than the predetermined quantity;

(2) the first status is being stored in the status storage device; and (3) the number stored in the fourth storage device is greater than a predetermined number.

With this configuration, it is possible to prevent the situation from occurring in which the information is not output even though the used consumption article housing case needs to be exchanged.

The following computer readable medium also has utility. The computer readable medium stores a computer program for an information processing device to be connected with a function executing device main body. The function executing device main body executes a function by utilizing a consumption article. The computer program includes instructions for ordering a computer mounted on the information processing device to perform:

(1) obtaining the quantity of the consumption article within a consumption article housing case mounted on the function executing device main body; and (2) outputting information to the exterior in a case where the quantity of the consumption article within the consumption article housing case mounted on the function executing device main body has become less than a predetermined quantity.

The computer program may prevent the information from being output twice or more in a period between a time where the consumption article housing case is mounted on the function executing device main body and a time where the consumption article housing case is dismounted from the function executing device main body and a next consumption article housing case is mounted on the function executing device main body. By utilizing this computer readable medium, it is possible to realize an information processing device that does not output information to the exterior a plurality of times for one consumption article housing case.

The information processing device may be requested to output information (the mount number, the detected result of the sensor, etc.) to the printer. The information processing device may determine whether to output information showing that the quantity of the consumption article within the consumption article housing case has become low in accordance with the information that is output from the printer.

The information processing device may output the information showing that the quantity of the consumption article within the consumption article housing case has become low via a remote communication network (Public Switched Telephone Network: PSTN, an internet network etc.). Moreover, the information processing device may store an email address. The information processing device may output the information showing that the quantity of the consumption article within the consumption article housing case has become low to the email address.

The embodiments are described above in detail, but these examples are merely illustrative. Various changes and modifications to the technique taught in the embodiments described above are possible. Variants of the above embodiments are given below.

(1) The initial value of the print number counter 18 and/or the initial value of the mount number counter 22 may be a number other than '0'. For example, in the case where the initial value of the print number counter 18 is 'N', the initial value of the output time print number storage 42 may also be 'N'. Further, in the case for example where the initial value of the mount number counter 22 is 'M', the initial value of the output time mount number storage 44 may also be 'M'.

(2) The interval by which the mount number counter 22 counts up may be a number other than '1'.

(3) The status storage 130 of the second embodiment may be provided on the PC 140.

(4) The devices 42, 44, 46, 48, etc. provided on the PCs 40, 140, and 240 may be housed within the printer 10, 110, 210. In this case, the systems 2, 102, and 202 can be realized by the printer 10 alone.

(5) In the first embodiment and the second embodiment, the print number counter 218 of the third embodiment may be adopted instead of the print number counter 18 and the output time print number storage 42.

What is claimed is:

1. A function executing device for executing a function by utilizing a consumption article, the function executing device comprising:

a device main body on which a consumption article housing case for housing the consumption article is to be mounted;

a sensor that detects the quantity of the consumption article within the consumption article housing case mounted on the device main body;

an information output device that outputs information to the exterior in a case where the quantity of the consumption article within the consumption article housing case mounted on the device main body has become less than a predetermined quantity, and a controller that controls the information output device, wherein the controller prevents the information output device from outputting the information twice or more in a period between a time where the consumption article housing case is mounted on the device main body and a time where the consumption article housing case is dismounted from the device main body and a next consumption article housing case is mounted on the device main body.

2. The function executing device as in claim 1, further comprising:

a first storage device that stores a number of consumption article housing cases that have been mounted on the device main body; and a second storage device that stores the number being stored in the first storage device when the information output device outputs the information, wherein the controller controls the information output device such that the information output device outputs the information in a case where a condition described below is satisfied:

(1) the quantity of the consumption article within the consumption article housing case mounted on the device main body has become less than the predetermined quantity; and (2) the number stored in the first storage device is greater than the number stored in the second storage device.

3. The function executing device as in claim 2, further comprising:

a printing device that prints on a print medium by utilizing the consumption article.

4. The function executing device as in claim 3, wherein the function executing device comprises a printer and an information processing device to be connected with the printer, the printer comprises the device main body, the sensor, the first storage device, the printing device, and a printer side output device that outputs the number stored in the first storage device and a detected result of the sensor to the information processing device, and the information processing device comprises the information output device, the controller, the second storage device, and an input device that inputs the number and the detected result output from the printer.

5. The function executing device as in claim 3, further comprising:

a third storage device that stores a number of print media that have been printed by the printing device after the information output device outputs the information, wherein the first storage device stores a number of new consumption article housing cases that have been mounted on the device main body, the first storage device does not count up in a case where a used consumption article housing case is mounted on the device main body, and the controller controls the information output device such that the information output device outputs the information in a case where a condition described below is satisfied:

(1) the quantity of the consumption article within the consumption article housing case mounted on the device main body has become less than the predetermined quantity;

(2) the number stored in the first storage device is equal to the number stored in the second storage device; and (3) the number stored in the third storage device is greater than a predetermined number.

6. The function executing device as in claim 5, wherein the controller prevents the information output device from outputting the information in a case where the number stored in the third storage device is less than the predetermined number.

7. The function executing device as in claim 3, further comprising:

a third storage device that stores a number of print media that have been printed by the printing device after the consumption article housing case was mounted on the device main body, wherein the first storage device stores a number of new consumption article housing cases that have been mounted on the device main body, the first storage device does not count up in a case where a used consumption article housing case is mounted on the device main body, and the controller controls the information output device such that the information output device outputs the information in a case where a condition described below is satisfied, (1) the quantity of the consumption article within the consumption article housing case mounted on the device main body has become less than the predetermined quantity;

(2) the number stored in the first storage device is equal to the number stored in the second storage device; and (3) the number stored in the third storage device is greater than a predetermined number.

8. The function executing device as in claim 1, further comprising:

a first storage device that stores a number of consumption article housing cases that have been mounted on the device main body; and a second storage device that stores an output number of the information, wherein the controller controls the information output device such that the information output device outputs the information in a case where a condition described below is satisfied:

(1) the quantity of the consumption article within the consumption article housing case mounted on the device main body has become less than the predetermined quantity; and (2) the number stored in the first storage device is greater than the output number stored in the second storage device.

9. The function executing device as in claim 8, further comprising:

a printing device that prints on a print medium by utilizing the consumption article; and a third storage device that stores a number of print media that have been printed by the printing device after the information output device outputs the information, wherein the first storage device stores a number of new consumption article housing cases that have been mounted on the device main body, the first storage device does not count up in a case where a used consumption article housing case is mounted on the device main body, and the controller controls the information output device such that the information output device outputs the information in a case where a condition described below is satisfied:

(1) the quantity of the consumption article within the consumption article housing case mounted on the device main body has become less than the predetermined quantity, (2) the number stored in the first storage device is equal to the output number stored in the second storage device; and (3) the number stored in the third storage device is greater than a predetermined number.

10. The function executing device as in claim 8, further comprising:

a printing device that prints on a print medium by utilizing the consumption article; and a third storage device that stores a number of print media that have been printed by the printing device after the consumption article housing case was mounted on the device main body, wherein the first storage device stores a number of new consumption article housing cases that have been mounted on the device main body, the first storage device does not count up in a case where a used consumption article housing case is mounted on the device main body, and the controller controls the information output device such that the information output device outputs the information in a case where a condition described below is satisfied:

(1) the quantity of the consumption article within the consumption article housing case mounted on the device main body has become less than the predetermined quantity;

(2) the number stored in the first storage device is equal to the output number stored in the second storage device; and (3) the number stored in the third storage device is greater than a predetermined number.

11. The function executing device as in claim 1, further comprising:

a status storage device that stores either a first status or a second status, wherein the status storage device stores the second status in a case where a consumption article housing case is mounted on the device main body while the first status is being stored, the status storage device stores the first status in a case where the information output device outputs the information while the second status is being stored, and the controller controls the information output device such that the information output device outputs the information in a case where a condition described below is satisfied:

(1) the quantity of the consumption article within the consumption article housing case mounted on the device main body has become less than the predetermined quantity; and (2) the second status is stored in the status storage device.

12. The function executing device as in claim 11, further comprising:

a printing device that prints on a print medium by utilizing the consumption article; and a first storage device that stores a number of print media that have been printed by the printing device after the information output device outputs the information, wherein the status storage device stores the second status in a case where a new consumption article housing case is mounted on the device main body while the first status is being stored, the status storage device does not store the second status in a case where a used consumption article housing case is mounted on the device main body while the first status is being stored, and the controller controls the information output device such that the information output device outputs the information in a case where a condition described below is satisfied:

(1) the quantity of the consumption article within the consumption article housing case mounted on the device main body has become less than the predetermined quantity;

(2) the first status is stored in the status storage device; and (3) the number stored in the first storage device is greater than a predetermined number.

13. The function executing device as in claim 11, further comprising:

a printing device that prints on a print medium by utilizing the consumption article; and a first storage device that stores a number of print media that have been printed by the printing device after the consumption article housing case was mounted on the device main body, wherein the status storage device stores the second status in a case where a new consumption article housing case is mounted on the device main body while the first status is being stored, the status storage device does not store the second status in a case where a used consumption article housing case is mounted on the device main body while the first status is being stored, and the controller controls the information output device such that the information output device outputs the information in a case where a condition described below is satisfied:

(1) the quantity of the consumption article within the consumption article housing case mounted on the device main body has become less than the predetermined quantity;

(2) the first status is stored in the status storage device; and (3) the number stored in the first storage device is greater than a predetermined number.

14. A computer readable medium storing a computer program for an information processing device to be connected with a function executing device main body, the function executing device main body executing a function by utilizing a consumption article, the computer program including instructions for ordering a computer mounted on the information processing device to perform:

obtaining the quantity of the consumption article within a consumption article housing case mounted on the function executing device main body; and outputting information to the exterior in a case where the quantity of the consumption article within the consumption article housing case mounted on the function executing device main body has become less than a predetermined quantity, wherein the computer program prevents the information from being output twice or more in a period between a time where the consumption article housing case is mounted on the function executing device main body and a time where the consumption article housing case is dismounted from the function executing device main body and a next consumption article housing case is mounted on the function executing device main body.

* * * * *